United States Patent [19]

Rainwater

[11] 4,084,598

[45] Apr. 18, 1978

[54] LINKED COLLAPSIBLE SHELTER STRUCTURE

[76] Inventor: Orman M. Rainwater, 947-½ N. Wilcox Ave., Los Angeles, Calif. 90038

[21] Appl. No.: 728,181

[22] Filed: Sep. 30, 1976

[51] Int. Cl.[2] ..... A45F 1/16

[52] U.S. Cl. ..... 135/3 E; 135/DIG. 5; 135/DIG. 9

[58] Field of Search ..... 135/1 R, 3 R, DIG. 5, 135/DIG. 9, 3 E, 5 R, 7.1 R

[56] References Cited

U.S. PATENT DOCUMENTS

| | | | |
|---|---|---|---|
| 1,592,356 | 7/1926 | Goldberg et al. | 135/DIG. 5 |
| 2,420,898 | 5/1947 | Miner | 135/1 R |
| 3,095,069 | 6/1963 | Winkler | 135/3 R |
| 3,397,710 | 8/1968 | McElroy | 135/3 R |
| 3,469,588 | 9/1969 | Rainwater | 135/5 R |

FOREIGN PATENT DOCUMENTS

| | | | |
|---|---|---|---|
| 1,115,615 | 1/1956 | France | 135/3 R |

*Primary Examiner*—Werner H. Schroeder
*Assistant Examiner*—Conrad L. Berman
*Attorney, Agent, or Firm*—Flam & Flam

[57] ABSTRACT

The collapsible shelter structure comprises a series of panels held in angularly spaced relationship to define a shelter structure. The framework of each panel comprises a pair of generally parallel bars held in spaced relationship by a single central strut. Corresponding ends of the bars are tied together by flexible means, such as a sheet of fabric, preventing the bars from moving out of parallel. The fabric is slightly stretched by the strut. Conveniently, a single bar is common to adjacent panels similarly formed. In order to determine the angularity of adjacent panels, each intermediate bar is provided with a link piloted on the central portion of the bar, the link having two angularly spaced rigid plugs, one detachably telescoped into the brace of one panel and the other detachably telescoped into the brace of the adjacent panel. A solid, but readily erected and collapsed shelter structure results.

4 Claims, 5 Drawing Figures

LINKED COLLAPSIBLE SHELTER STRUCTURE

FIELD OF THE INVENTION

This invention relates to collapsible shelter structures that may be used for a wide variety of purposes, such as camping, providing temporary field offices, providing add-on banquet spaces, etc. More particularly, this invention relates to collapsible shelter structures of the type shown and described in my U.S. Pat. No. 3,469,588 issued Sept. 30, 1969 and entitled Articulated Multisection Shelter or Frame Structure.

BACKGROUND OF THE INVENTION

One of the shelter structures shown and described in my said USA patent comprises, when collapsed, a series of poles or bars accommodated in spaced apart parallel pockets, rolled up with a plurality of loose tubular struts or braces. The structure is erected by placement of the struts between the bars or poles, slightly stretching the flexible panel. The braces detachably connect at opposite ends with individual plugs pivotally mounted at the center of the poles or bars. The stress in the panel keeps the strut in place. In order to determine the angularity between adjacent sections of the shelter, a toggle brace is provided. The primary object of the present invention is to improve upon the foregoing arrangement, particularly as to the manner of determining and sturdily maintaining the angularity between the panels.

SUMMARY OF INVENTION

In order to accomplish the foregoing objective, I provide a pivot link mounted centrally of each intermediate pole or bar. The pivot link has two angularly spaced pins for connection to the respective struts of adjacent panels. The pins are each rigidly connected to the central hub of the link and sturdily determine and maintain a present angularity. Toggle braces are replaced by a rigid structure having no danger of accidental folding.

BRIED DESCRIPTION OF DRAWINGS

A detailed description of the invention will be made with reference to the accompanying drawings wherein like numerals designate corresponding parts in the several figures. These drawings, unless described as diagrammatic or unless otherwise indicated, are to scale.

FIG. 1 is a pictorial view of a shelter structure incorporating the present invention.

FIGS. 2 and 3 are enlarged fragmentary sectional views taken along planes corresponding to lines 2—2 and 3—3 of FIG. 1.

DETAILED DESCRIPTION OF PREFERRED EMBODIMENT

The following detailed description is of the best presently contemplated mode of carrying out the invention. This description is not to be taken in a limiting sense, but is made merely for purposes of illustrating the general principles of the invention since the scope of the invention is best defined by the appended claims.

Figure 1:
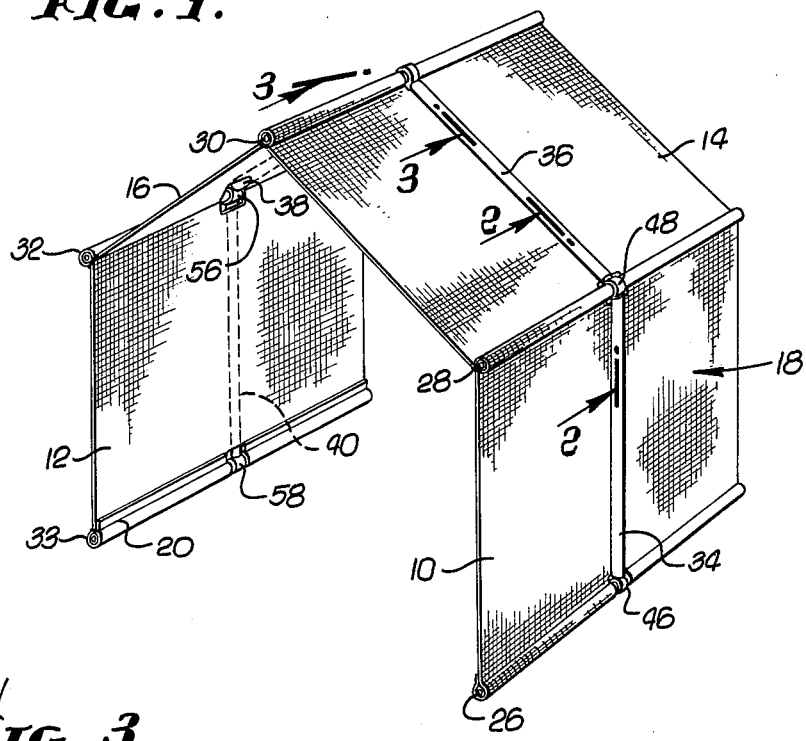

The shelter structure shown in FIG. 1 is typical of many that may incorporate the principles of the present invention. In the present instance, the shelter comprises a series of panels, two side panels 10 and 12 and two roof panels 14 and 16. The panels are formed as successive sections in a one piece webbing 18.

Figure 3:
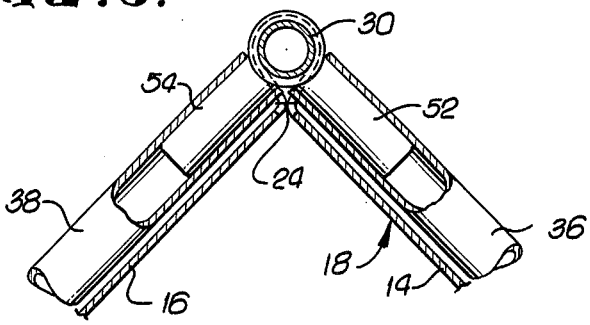
Figure 2:
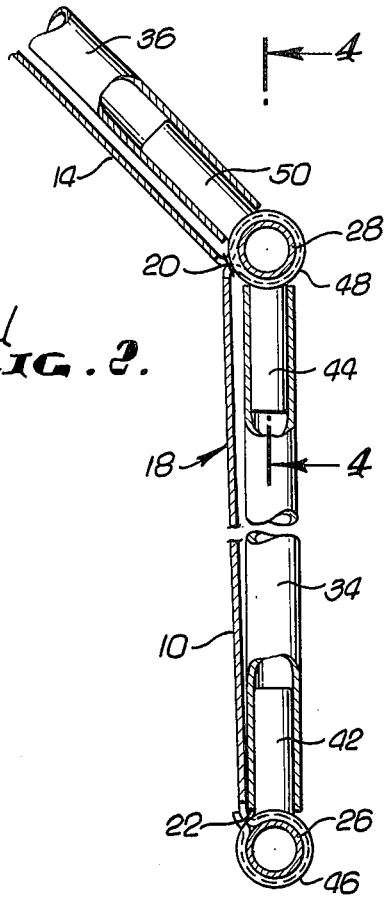

The webbing 18 is sewn, as at 20 and 22 (FIG. 2) and 24 (FIG. 3) to form transverse pockets for accommodating poles or bars 26, 28, 30, 32 and 33. In order to give form to the panels, the webbing between adjacent poles is made taut.

Figure 5:
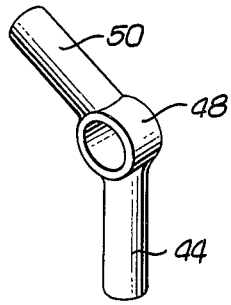
FIG. 5 is a pictorial view of one of the links.

For this purpose, tubular struts 34, 36, 38 and 40 are provided, one for each panel. The struts lie on the outside of the webbing. Each strut detachably connects at opposite ends to links at the central portions of the bars of the corresponding panel. The strut 34, for example, (FIG. 2) has its lower end telescoped over a pin 42 attached to the center of the pole 26 and its upper end telescoped over a pin 44 attached to the center of the pole 28. The pin 42 projects from a generally cylindrical hub 46 (see also FIG. 1) journalled on pole 26. The pin is accessible on the outside at a cutout hole in the webbing and pole pocket. Similarly, the pin 44 for the other end of the strut 34 projects from a generally cylindrical hub 48 (see also FIG. 5) journalled at the center of the pole 28. When the strut 34 is in place, the webbing between the spaced apart poles 26 and 28 is under slight tension whereby the panel assumes a well defined planar form. The webbing may be provided with any variety of windows or roof openings as desired.

In order to install the strut 34, one end is telescoped over one of the pins 42 or 44. The other end of the companion pin is then moved angularly away from the ultimate line of the strut until the pin just enters the end of the strut, at which time the webbing will be nearly taut. Then, by stretching the webbing further, the pin and strut can be rotated into line, the tension in the webbing serving to snap the parts together as a toggle.

Figure 4:
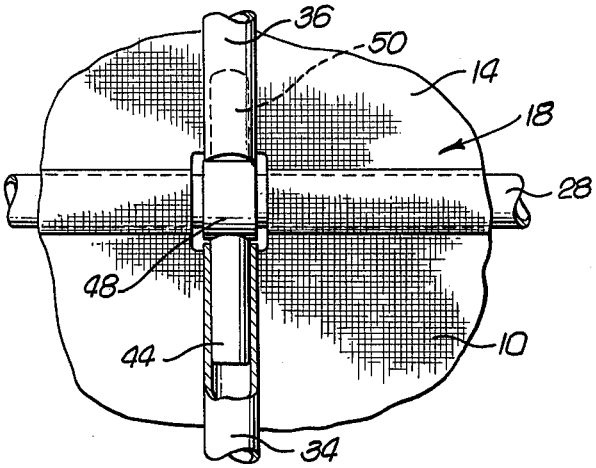
FIG. 4 is a fragmentary side elevational view showing the link between a side panel and a roof panel of the structure of FIG. 1.

The next strut 36 is similarly installed. One end of the strut 36 cooperates with a pin 50 (FIGS. 2, 4 and 5) that projects from the same hub 48 to which the pin 44 is attached. The other end of the strut cooperates with a link (FIG. 3) having two pins 52 and 54 projecting in angularly spaced relationship from a common hub 56. The strut 36 engages one of the pins 52. The strut 38 of the next panel cooperates with the other pin 54. Links 56 and 58 (FIG. 1) similar to those described cooperate with the struts 38 and 40 to complete the structure.

The intermediate links each have two pins in present angularly spaced relationship. The angularity of the pins of each link determine the angularity of the adjacent panels with which they cooperate. No folding braces are required. A very sturdy structure results. An unintended engagement of the link will not cause an accidental collapse of the structure. Yet no locking devices of any kind are required. The parts are few in number, yet manifestly simple.

The shelter is easily collapsed and rolled up with the detached struts. The links remain in place, being prevented from moving by the edges of the pole accommodating pockets. No guesswork is required in putting the parts of the shelter together.

Intending to claim all novel, useful and unobvious features shown or described, I make the following claims:

1. In a collapsible shelter structure:

a. a resilient stretchable webbing having a plurality of transverse pockets spaced along the length of the webbing and dividing the webbing into a series of panels, each pocket being at least partially discontinuous at its midlength position to provide an opening on the outside of said shelter;

b. a corresponding plurality of tubular bars or poles accommodated in the pockets, there being two end bars for the pockets at the ends of the webbing and intermediate bars for the other pockets, the intermediate bars or poles having a circular cross-sectional configuration;

c. a corresponding plurality of links, each of the links having a hub journalled at the center of the corresponding bars in alignment with the opening of the corresponding pocket;

d. each of the links for the intermediate bars or poles having rigidly connected to its corresponding hub, a pair of angularly spaced pins projecting radially therefrom in substantially coplanar relationship on the outside of said shelter;

e. each of the links for the end bars or poles having rigidly connected to its corresponding hub, a single pin projecting radially therefrom on the outside of shelter;

f. a plurality of tubular struts on the outside of said shelter having opposite ends telescoped over pins of links for adjacent poles or bars to hold said poles or bars apart with the webbing taut; said struts being of fixed length and movable into connected relationship with said pins one after the other, the connection to the second connector element being established by stretching the webbing until the telescopic connection is made; and g. the angular spacing of the pins of said intermediate links determining the angularity between adjacent panels and, thereby, the angular orientation of all panels of said shelter structure.

2. In a collapsible shelter structure:

a. a resilient stretching webbing;

b. means forming a pocket in the webbing for a ridge pole, each pocket being at least partially discontinuous at its midlength position to provide an opening on the outside of said shelter;

c. a ridge pole in the pocket having a substantially circular cross-sectional configuration;

d. a link having a hub journalled substantially centrally of the ridge pole in alignment with the opening of the pocket, having a pair of angularly spaced pins projecting radially of the hub in substantially coplanar relationship on the outside of said shelter;

e. a first hollow strut on the outside of said shelter structure telescopically connected at one end to one of said pins, said strut extending transversely to said ridge pole;

f. a second hollow strut on the outside of said shelter structure telescopically connected at one end to the other of said pins, said second strut extending transverse to said ridge pole;

g. means carried by said webbing on one side of said first strut; and h. means carried by said webbing on the other side of said pocket for detachably anchoring the other end of said second strut.

3. The collapsible shelter structure as set forth in claim 2 in which said detachable anchoring means comprise additional poles accommodated in additional pockets of said webbing, the additional pockets each being at least partially discontinuous at its midlength position to provide an opening at the outside of said shelter; and additional links mounted substantially centrally of said additional poles in alignment with the openings of the corresponding pockets, each of said additional links having pins on the outside of said shelter telescopically engaging the said other ends of said struts.

4. In a collapsible shelter structure:

a. a resilient stretchable webbing having three transverse elongated pockets spaced from each other along the length of the webbing and dividing the webbing into two adjacent panels, each pocket being at least partially discontinuous at its midlength position to provide an opening on the outside of said shelter;

b. three frame elements accommodated respectively in the pockets, the central portion of each frame element being substantially circular in peripheral contour;

c. three links for the frame elements respectively, and each having a hub journalled on the central portion of the corresponding frame element in alignment with the opening of the corresponding pocket;

d. the link for the center frame element having two pins projecting from the hub in fixed angularly spaced substantially coplanar relationship on the outside of said shelter;

e. the other two links each having a pin projecting radially therefrom on the outside of said shelter;

f. two struts on the outside of said shelter structure, one for each of the panels, each strut having one of its ends detachably telescoped over one of the pins of the center frame link and its other end detachably connected to the pin of the link for the corresponding end frame element;

g. said struts holding the webbing taut while the webbing urges the connector elements into assembled relationship with the struts;

h. said connector elements of the link of the center frame connector element determining the angularity of said panels with respect to each other.

* * * * *